US008985228B2

(12) United States Patent
Xu et al.

(10) Patent No.: US 8,985,228 B2
(45) Date of Patent: Mar. 24, 2015

(54) TREATMENT PLUG AND METHOD OF ANCHORING AND SEALING THE SAME TO A STRUCTURE

(75) Inventors: YingQing Xu, Tomball, TX (US); Graeme Michael Kelbie, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 573 days.

(21) Appl. No.: 13/358,287

(22) Filed: Jan. 25, 2012

(65) Prior Publication Data

US 2013/0186650 A1 Jul. 25, 2013

(51) Int. Cl.
*E21B 33/129* (2006.01)

(52) U.S. Cl.
USPC ..... 166/386; 166/192

(58) Field of Classification Search
CPC .. E21B 33/1265; E21B 33/1295; E21B 23/01
USPC ..... 166/386, 192, 193, 196
See application file for complete search history.

(56) References Cited

U.S. PATENT DOCUMENTS 2,507,270 A * 5/1950 Ragan ..... 166/121
5,775,429 A 7/1998 Arizmendi et al.
6,896,049 B2 5/2005 Moyes
7,614,449 B2 11/2009 Anderson
2009/0071641 A1 3/2009 Gaudette et al.
2001/0277987 11/2011 Frazier

OTHER PUBLICATIONS

Coronado, Martin P., "Development of an Internal Coiled Tubing Connector Utilizing Permanent Packer Technology"; SPE 46036; Society of Petroleum Engineers, Inc.; 1998 SPE/ICoTA Coiled Tubing Roundtable; Houston, Texas; Apr. 15-16, 1998; pp. 139-148.
International Preliminary Report on Patentability for International Application No. PCT/US2012/071737 Mailed Jul. 29, 2014.
Model "F-1" and "FB-1" Retainer Production Packers; Baker Packers Catalog 2014; p. 508.
Smith, et al., "Deepwater Remotely Actuated Completions for the 21st Century"; OTC 8844; 1998 Offshore Technology Conference; Houston, Texas; May 4-7, 1998; pp. 473-487.

* cited by examiner

*Primary Examiner* — David Andrews
(74) *Attorney, Agent, or Firm* — Cantor Colburn LLP

(57) ABSTRACT

A treatment plug includes, an anchor runnable and settable within a structure having, at least two slips movably engaged with one another to cause the at least two slips to move radially into engagement with the structure in response to longitudinal movement between the at least two slips. The treatment plug also has at least one seal having a deformable metal member configured to radially deform into sealing engagement with the structure in response to longitudinal compression of the deformable metal member, and a seat that is sealingly receptive to a plug.

23 Claims, 5 Drawing Sheets

TREATMENT PLUG AND METHOD OF ANCHORING AND SEALING THE SAME TO A STRUCTURE

BACKGROUND

Tubular systems, such as those used in the completion and carbon dioxide sequestration industries often employ anchors to positionally fix one tubular to another tubular, as well as seals to seal the tubulars to one another. Although existing anchoring and sealing systems serve the functions for which they are intended, the industry is always receptive to new systems and methods for anchoring and sealing tubulars.

BRIEF DESCRIPTION

Disclosed herein is a treatment plug. The treatment plug includes, an anchor runnable and settable within a structure having, at least two slips movably engaged with one another to cause the at least two slips to move radially into engagement with the structure in response to longitudinal movement between the at least two slips. The treatment plug also has at least one seal having a deformable metal member configured to radially deform into sealing engagement with the structure in response to longitudinal compression of the deformable metal member, and a seat that is sealingly receptive to a plug.

Further disclosed herein is a method of anchoring and sealing a treatment plug. The method includes, longitudinally moving a first half of a plurality of slips relative to a second half of the plurality of slips, altering a radial dimension defined by the plurality of slips, anchoring the plurality of slips to a structure, longitudinally compressing at least one deformable member, and sealingly engaging the structure with the at least one deformable member.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
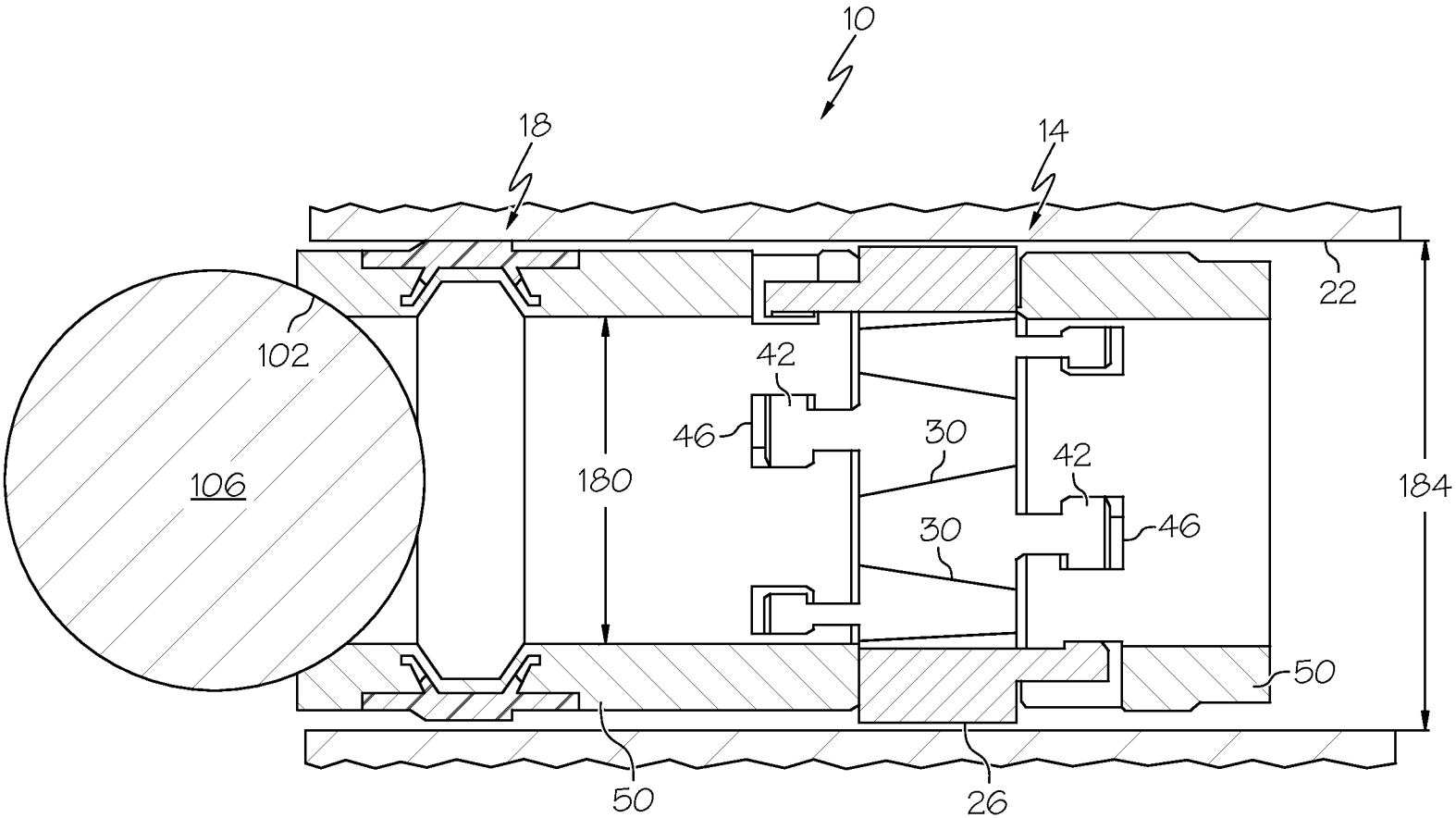
FIG. 1 depicts a cross sectional view of a treatment plug disclosed herein positioned within a structure.
Figure 2:
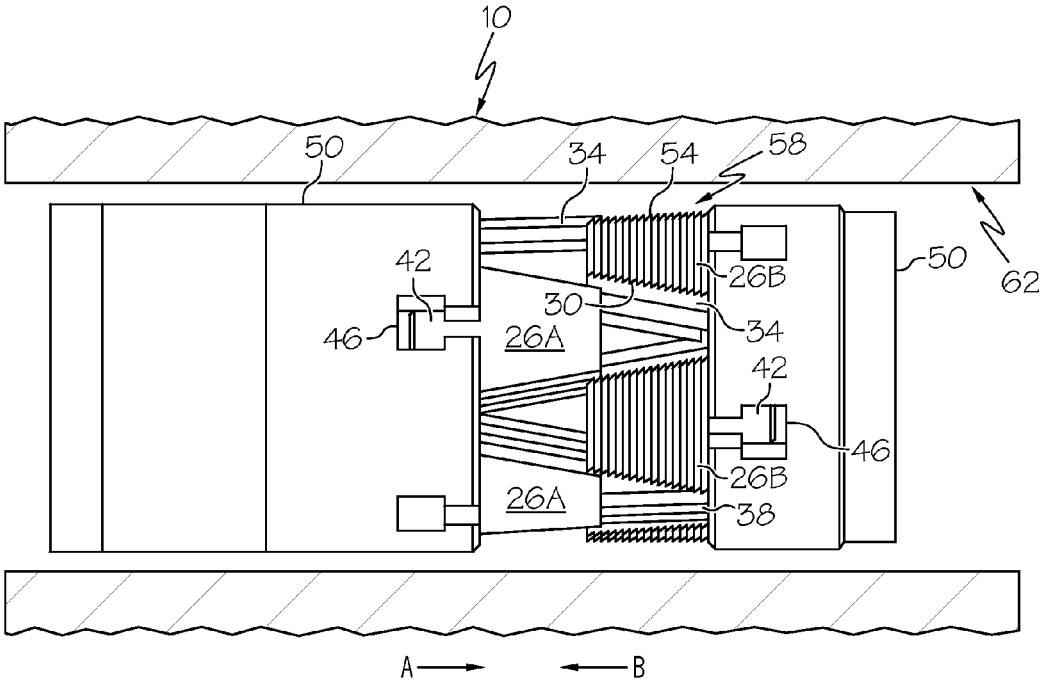
FIG. 2 depicts a side view of the treatment plug of FIG. 1 shown in a non-anchored and non-sealing configuration.
Figure 3:
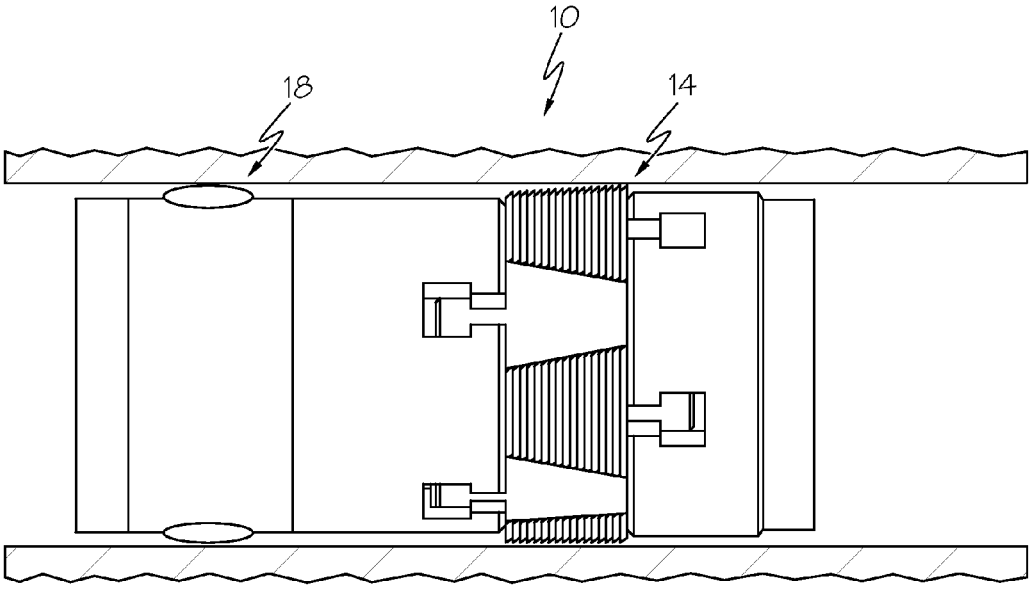
FIG. 3 depicts a side view of the treatment plug of FIG. 1 shown in a sealed and anchored configuration.

Referring to FIG. 1, an embodiment of a treatment plug disclosed herein is illustrated at 10. The treatment plug 10 includes an anchor 14 and at least one seal 18, with a single seal 18 being illustrated in this embodiment, that are anchorable and sealable, respectively to a structure 22 shown herein as a casing or liner, although any tubular shaped structure, including an open earth formation borehole, could serve as the structure.

The anchor 14 has a plurality of slips 26, a first half 26A of which are movable in a first direction according to arrow 'A' relative to a second half 26B movable in a second direction according to arrow 'B;' the first direction being longitudinally opposite to the second direction. Each of slips 26 has opposing perimetrical edges 30 that are tapered to form a perimetrical wedge shape. Additionally each of slips 26 in the first half 26A are positioned perimetrically between adjacent slips 26 of the second half 26B. A tongue 34 on one edge 30 fits into a groove 38 on a complementary edge 30. This tongue 34 and groove 38 arrangement maintains the slips 26 at a radial dimension relative to each other of the slips 26. As such, all of the slips 26 move radially in unison in response to the first half 26A moving longitudinally relative to the second half 26B of the slips 26. One should appreciate that a perimetrical (indeed substantially circumferential in the Figures) dimension defined by the slips 26 will increase when the two halves 26A, 26B are moved longitudinally toward one another and decrease as the two halves 26A, 26B are moved longitudinally away from one another. A 'T' shaped tab 42 on each of the slips 26 is radially slidably engaged with a slot 46 in a collar 50 to allow the slips 26 to move radially while being supported in both longitudinal directions. Although not shown in the Figures, a tubular or membrane could be sealably engaged with both of the collars 50 to prevent fluidic communication between an outside and an inside of the components of the treatment plug 10 through the gaps between tabs 42 and the slots 46 or clearances between the adjacent slips 26.

Optionally, teeth 54, also known as wickers, on an outer surface 58 of the slips 26 can bitingly engage with a surface 62 of the structure 22 to increase locational retention of the anchor 14 within the structure 22. This biting engagement can hold the two halves 26A, 26B relative to one another in the longitudinally compressed position so that external means of holding them in such a position is not required.

Figure 4:
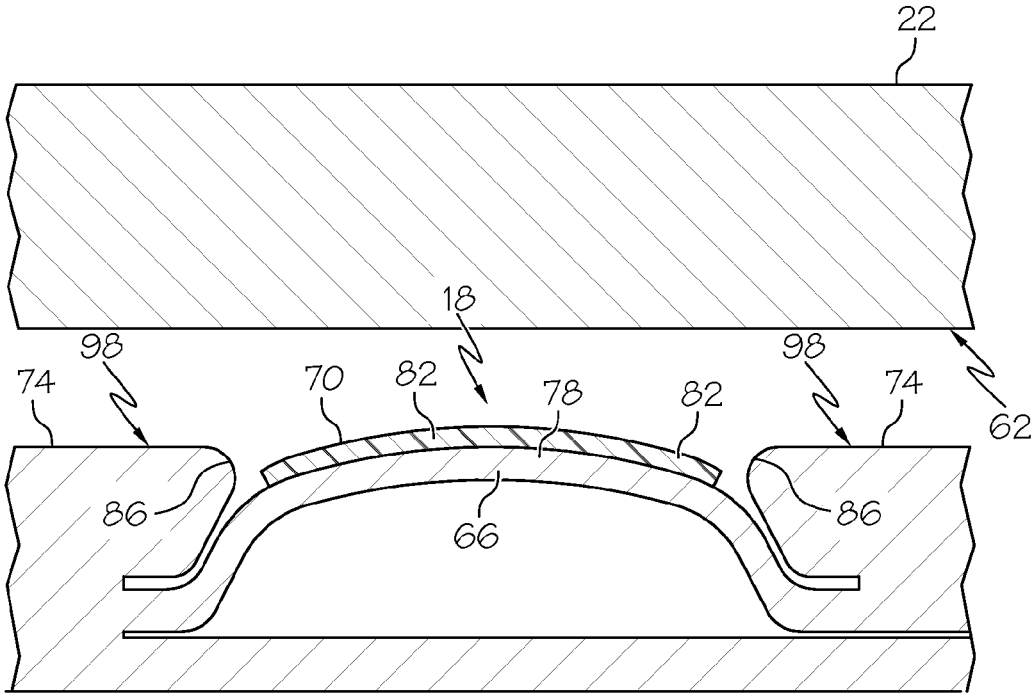
FIG. 4 depicts a partial cross sectional view of a seal disclosed herein shown in a non-sealing configuration.
Figure 5:
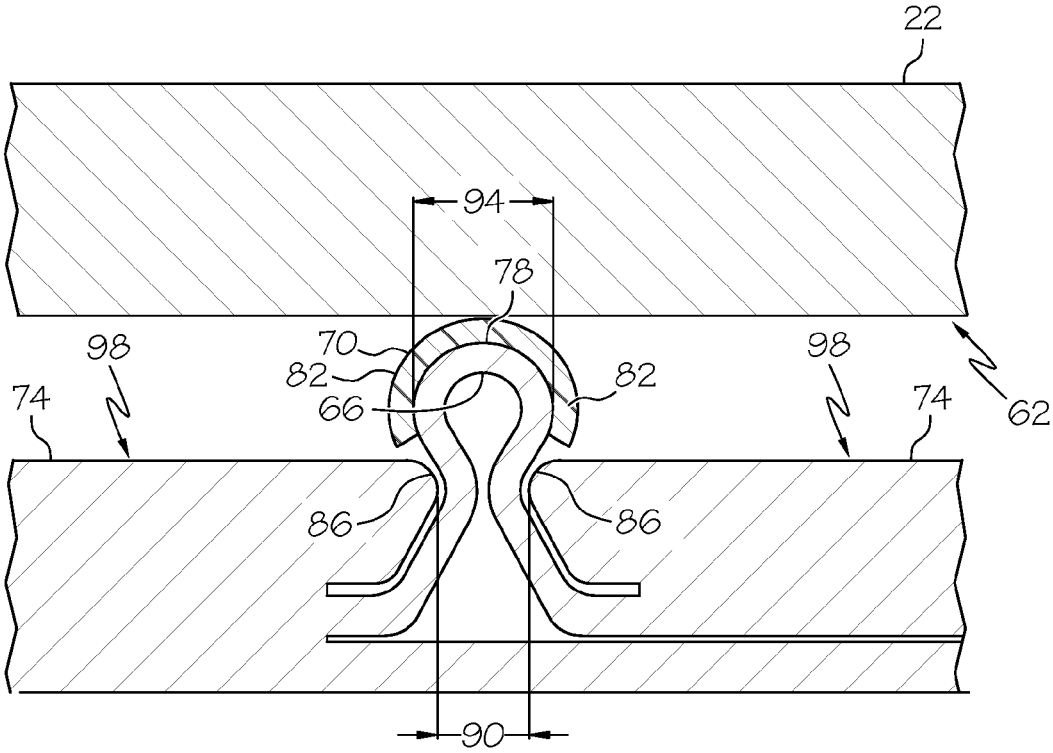
FIG. 5 depicts a partial cross sectional view of the seal of FIG. 4 shown in a sealing configuration.

Referring to FIGS. 4 and 5, the seal 18 has a deformable metal member 66 that is radially deformable in response to longitudinal compression thereof. The seal 18 is positioned and configured such that the radial deformation causes the deformable metal member 66 to sealingly engage with the surface 62 of the structure 22. An optional polymeric member 70 (made of polymeric material) located radially of the deformable metal member 66 may be used to improve sealing between the deformable metal member 66 and the surface 62.

The deformable metal member 66 has a thin cross section in comparison to collars 74 displaced in both longitudinal directions from the deformable metal member 66. This difference in cross sectional thickness assures that the deformable metal member 66, and not the collars 74, deform when longitudinally compressed. The deformable metal member 66 may also have a profile such that a longitudinal central portion 78 is displaced radially from portions 82 immediately to either longitudinal side of the central portion 78. This relationship creates stress in the deformable metal member 66 to control a radial direction in which the central portion 78 will move when longitudinal compressive forces are applied to the deformable metal member 66.

The collars 74 each have a shoulder 86 that is contactable by the deformable metal member 66 during deformation thereof. The shoulders 86 may be contoured to allow the deformable metal member 66 to follow during deformation to control a shape of the deformation. These contours can prevent sharp bends in the deformation that might result in undesirable rupturing of the deformable metal member 66 had the contours not been present. A minimum dimension 90 between the shoulders 86 may be less than a maximum longitudinal dimension 94 of the deformable metal member 66 after deformation. By plastically deforming the deformable metal member 66 the as deformed position (illustrated in FIG. 5) can be maintained without having to hold the collars 74 longitudinally relative to one another as is often required of typical seal devices.

The seal 18 of this embodiment is further configured such that the central portion 78 is located radially within surfaces 98 defining a maximum radial dimension of the collars 74 prior to deformation of the deformable metal member 66 but is located radially outside of the surfaces 98 after deformation. It should be noted that other embodiments are contemplated wherein the direction of deformation of the deformable metal member 66 is opposite to that shown in the Figures. In such an embodiment the relationships discussed herein would be reversed.

Referring again to FIG. 1, a seat 102 is sealingly receptive to a plug 106, shown herein as a ball, runnable there against. The seat 102 is positioned on a side of the seal 18 that is longitudinally opposite to a side on which the anchor 14 is located. Pressuring up against the plug 106 sealed against the seat 102 allows an operator employing the treatment plug 10 to do work therewith such as, fracturing an earth formation, or actuating a pressure actuator, for example, in a hydrocarbon recovery or a carbon dioxide sequestration application. Additionally, pressure applied against the seated plug 106 could be used to generate forces needed to compress the seal 18 into sealing engagement with the structure 22 or to urge the first half 26A of the slips 26 toward the second half 26B of the slips 26 to set the anchor 14.

Figure 6:
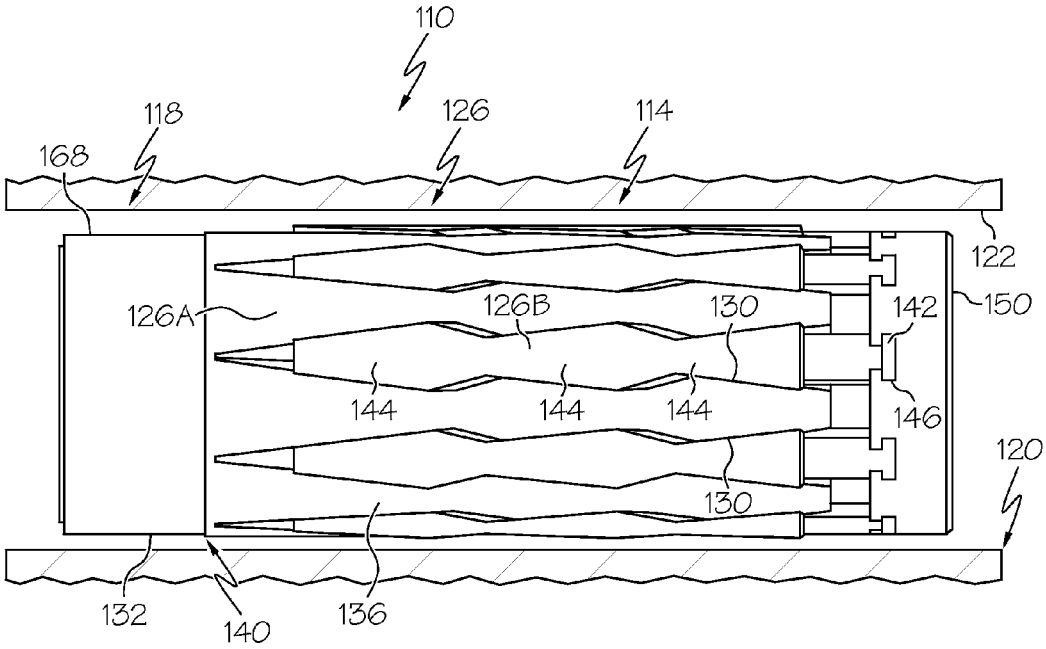
FIG. 6 depicts a side view of an alternate embodiment of a treatment plug disclosed herein.

Referring to FIG. 6, an alternate embodiment of a treatment plug disclosed herein is illustrated at 110. The treatment plug 110 includes an anchor 114 and at least one seal 118, with a single seal 118 being illustrated in this embodiment, that are anchorable and sealable, respectively to a structure 122 shown herein as a casing or liner, although any tubular shaped structure, including an open earth formation borehole, could serve as the structure.

The anchor 114 has a plurality of slips 126, a first half 126A of which are movable in a first direction according to arrow 'C' relative to a second half 126B movable in a second direction according to arrow 'D,' the first direction being longitudinally opposite to the second direction. Each of slips 126 has opposing perimetrical edges 130 that are tapered to form a perimetrical wedge shape. Additionally each of slips 126 in the first half 126A are positioned perimetrically between adjacent slips 126 of the second half 126B. As such, all of the slips 126 move radially in unison in response to the first half 126A moving longitudinally relative to the second half 126B of the slips 126. One should appreciate that a perimetrical (indeed substantially circumferential in the Figures) dimension defined by the slips 126 will increase when the two halves 126A, 126B are moved longitudinally toward one another and decrease as the two halves 126A, 126B are moved longitudinally away from one another. A 'T' shaped tab 142 on each of the slips 126 in the second half 126B is radially slidably engaged with a slot 146 in a collar 150 to allow the slips 126B to move radially while being supported in both longitudinal directions. The slips 126 of the first half 126A differ from the slips 26A of the anchor 14 in that the slips 126A do not include 'T' shaped tabs but instead are integrally formed as part of a sleeve 132. As such an area 140 defined where the sleeve 132 and fingers 136 of the slips 126A meet will deform as the fingers 136 radially expand while the sleeve 132 does not.

Another difference between the anchor 114 and the anchor 14 is that each of the slips 126 has a plurality of wedge shaped portions 144 displaced longitudinally from one another. The illustrated embodiment includes three such wedge portions 144 although any practical number of the wedge portions 144 is contemplated. One effect of employing more than one of the wedge portions 144 is the anchor 114 is able to engage with walls 120 of a structure 122 within which the anchor 114 is deployed over a greater longitudinal span.

Figure 7:
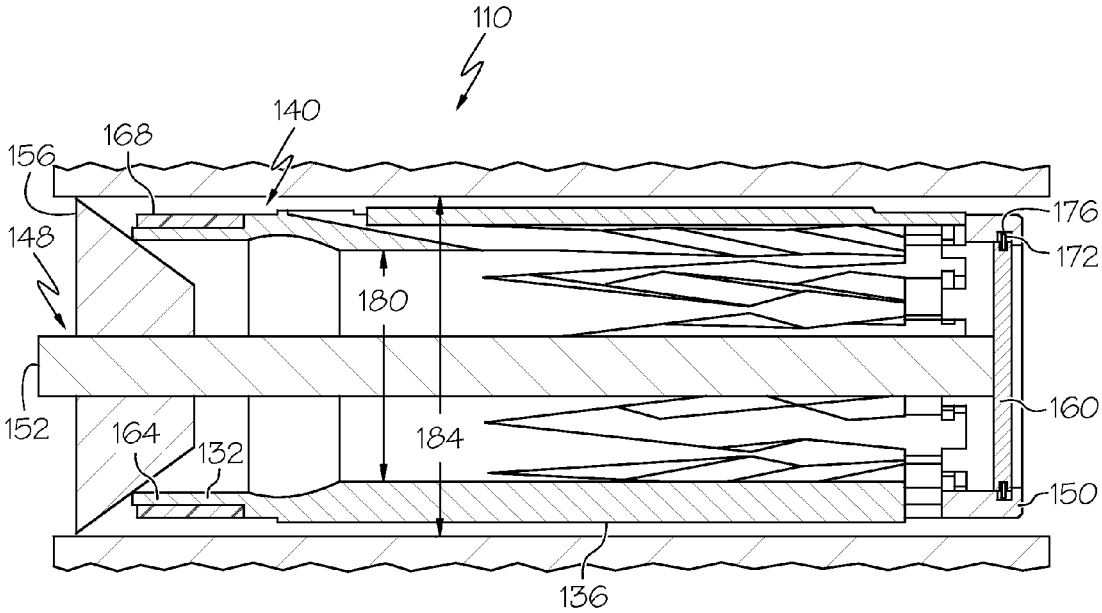
FIG. 7 depicts a cross sectional view of the treatment plug of FIG. 6 with a swaging tool engaged therewith.

Referring to FIG. 7 a swaging tool 148 is shown engaged with the treatment plug 110. The swaging tool 148 has a mandrel 152 that aligns a swage 156 and a plate 160. The swage 156 is sized and configured to increase radial dimensions of a portion 164 of the sleeve 132 when forced therethrough. In so doing, a seal element 168 positioned radially of the portion 164 is displaced into sealing engagement with the walls 120 of the structure 122. The plate 160 includes a shear ring 172 where it engages with a groove 176 in the collar 150. Movement of the plate 160 towards the swage 156 of the swaging tool 148 causes the first half 126A of the slips to move longitudinally relative to the second half 126B of the slips 126 thereby causing them to move radially outwardly into anchoring engagement with the walls 120 of the structure 122. The shear ring 172 is designed to shear, thereby releasing the swaging tool 148 from engagement with the treatment plug 110, at forces greater than would be applied thereto during either of the swaging operation or the anchoring operation. As such, once swaging and anchoring is complete the swaging tool 148 can be retrieved upon shearing of the shear ring 172.

Figure 8:
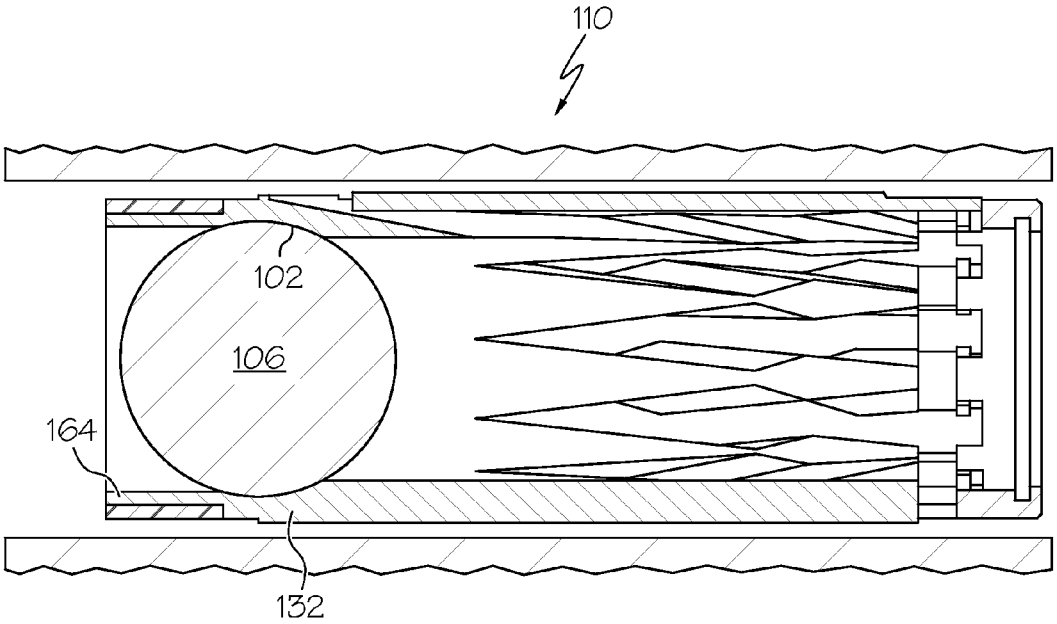
FIG. 8 depicts a cross sectional view of the treatment plug of FIG. 6 with a plug seated thereagainst.

Referring to FIG. 8, a plug 106 is shown seated on a seat 102 of the treatment plug 110 in a similar fashion as to that of the treatment plug 10 in FIG. 1.

The treatment plugs 10, 110 disclosed herein are designed to have a large minimum through bore dimension 180 in relation to the minimum radial dimension 184 of the structure 122 (see FIGS. 1 and 7). The large dimension 180 means that the treatment plugs 10, 110 do not require drilling or milling therethrough prior to completion and production, as is required of typical treatment plugs, as production can flow through the minimum through bore dimension 180 directly. Typically available treatment plugs employ composite materials for the bulk of the assembly (with only the slips being made of metal) because it is easier to drill through than if the bulk of the treatment plug were made of metal, for example. Since the composite materials employed are weaker than metal the cross sectional dimensions need to be larger to support the loads encountered. These larger cross sectional dimensions equates to a smaller bore dimension through which to produce. The treatment plugs 10, 110 disclosed herein rely upon the high hoop strength provided by the wedge shape of the slips 26, 126 and the high material strength of metal employed in the slips 26, 126 to allow the loads to be supported while leaving the relatively large bore dimension 180 therethrough.

Similarly, the seals 18, 118 also employ relatively thin walled metal material that when deformed into sealing engagement with structures 22, 122 can maintain the needed sealing loads while having the large bore dimension 180 therethrough. In fact, studies have shown that the treatment plugs 10, 110 disclosed herein can have bore dimensions 180 that are in the range of 80% to 85% of the minimum radial dimension 184 of the structure 122.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A treatment plug comprising:

an anchor runnable and settable within a structure having;

at least two slips movably engaged with one another to cause the at least two slips to move radially into engagement with the structure in response to longitudinal movement between the at least two slips;

at least one seal having a deformable metal member configured to radially deform into sealing engagement with the structure in response to longitudinal compression of the deformable metal member; and a seat that is sealingly receptive to a plug, the at least one seal being positioned longitudinally between the seat and the at least two slips thereby permitting the seal to be compressed between the slips and a plug seated against the seat.

2. The treatment plug of claim 1, wherein the at least two slips is a plurality of slips with a first half of the plurality of slips being longitudinally movable together relative to a second half of the plurality of slips.

3. The treatment plug of claim 2, wherein each of the plurality of slips has a first perimetrical edge that is perimetrically tapered relative to a second perimetrical edge, the first perimetrical edge being perimetrically opposite to the second perimetrical edge.

4. The treatment plug of claim 3, wherein each of the plurality of slips is perimetrically wedged between two other of the plurality of slips.

5. The treatment plug of claim 4, wherein the perimetrical wedging causes a radial dimension defined by surfaces of the plurality of slips to alter when the first half of the plurality of slips is urged longitudinally relative to the second half of the plurality of slips.

6. The treatment plug of claim 3, wherein the first perimetrical edge of each of the plurality of slips has a tongue engagable with a groove on the second perimetrical edge of another of the plurality of slips.

7. The treatment plug of claim 6, wherein alteration of the radial dimension includes an increase thereof.

8. The treatment plug of claim 7, wherein the increase of the radial dimension causes the plurality of slips to fixedly engage with the structure to thereby anchor the treatment plug to the structure.

9. The treatment plug of claim 1, wherein engagement of the at least two slips with the structure maintains the at least two slips in relative longitudinal position with each other.

10. The treatment plug of claim 1, further comprising a polymeric member in operable communication with the deformable metal member configured to sealingly engage with both the deformable metal member and the structure when the deformable metal member is in a deformed configuration.

11. The treatment plug of claim 1, wherein the deformable metal member is configured to remain substantially in a deformed position without external forces being applied thereto.

12. The treatment plug of claim 1, further comprising two collars having maximum radial dimensions that a portion of the deformable metal member extends radially beyond when in a deformed position.

13. The treatment plug of claim 12, wherein the two collars have shoulders that are longitudinally closer to one another than a maximum longitudinal dimension of the portion of the deformable metal member that extends radially therebeyond.

14. The treatment plug of claim 1, wherein the treatment plug includes more than one of the at least one seals.

15. The treatment plug of claim 1, wherein the plug is a ball.

16. The treatment plug of claim 1, wherein pressure built against a plug seated at the seat urges a half of the at least two slips to longitudinally move relative to the other half of the at least two slips to set the anchor.

17. The treatment plug of claim 1, wherein pressure built against a plug seated at the seat generates forces to longitudinally compress the deformable metal member.

18. The treatment plug of claim 1, wherein no treatment plug bears tensive loading during setting of the slips.

19. The treatment plug of claim 1, wherein a minimum through bore of the treatment plug is in the range of about 80% to 85% of the minimum radial dimension of the structure where the treatment plug is positioned.

20. The treatment plug of claim 1, wherein the treatment plug is configured to produce through a minimum bore dimension therethrough without having to be milled or drilled to increase a size thereof.

21. A method of anchoring and sealing a treatment plug to a structure, comprising:

longitudinally moving a first half of a plurality of slips relative to a second half of the plurality of slips;

altering a radial dimension defined by the plurality of slips;

anchoring the plurality of slips to a structure;

longitudinally compressing at least one deformable member; sealingly engaging the structure with the at least one deformable member;

building pressure against a plug seated at a seat of the treatment plug positioned in a direction upstream of the deformable member, the deformable member being positioned in a position upstream of the plurality of the slips, upstream being defined by pressure causing the plug to seat; and compressing the deformable member between the plugged seat and the anchored plurality of slips.

22. The method of anchoring and sealing a treatment plug to a structure of claim 21, further comprising compressing a polymeric member between the at least one deformable member and the structure.

23. The method of anchoring and sealing a treatment plug to a structure of claim 21, further comprising avoiding tensive loading any portion of the treatment plug during the compressing of the deformable member between the plugged seat and the anchored plurality of slips.

* * * * *